US006860734B2

(12) United States Patent
Zia et al.

(10) Patent No.: US 6,860,734 B2
(45) Date of Patent: Mar. 1, 2005

(54) MICRO INSHOT BURNER

(75) Inventors: Ninev Karl Zia, Indianapolis, IN (US); Chi Ming Ho, Manlius, NY (US); Brian A. Reeves, West Point, IN (US)

(73) Assignee: Carrier Corporation, Farmington, CT (US)

( * ) Notice: Subject to any disclaimer, the term of this patent is extended or adjusted under 35 U.S.C. 154(b) by 0 days.

(21) Appl. No.: 10/634,522

(22) Filed: Aug. 5, 2003

(65) Prior Publication Data

US 2004/0072115 A1 Apr. 15, 2004

Related U.S. Application Data

(63) Continuation of application No. 10/045,994, filed on Oct. 19, 2001, now abandoned.

(51) Int. Cl.[7] ..... F23D 14/58
(52) U.S. Cl. ..... 431/354; 431/350; 431/286
(58) Field of Search ..... 431/354, 264, 431/266, 286, 349, 355, 350, 346; 126/116 R

(56) References Cited

U.S. PATENT DOCUMENTS

| | | | | | |
|---|---|---|---|---|---|
| 3,259,170 | A | * | 7/1966 | Koehrer | 239/416.5 |
| 3,653,371 | A | * | 4/1972 | McManus | 126/91 R |
| 4,846,143 | A | * | 7/1989 | Csadenyi | 126/39 E |
| 5,035,609 | A | * | 7/1991 | Riehl | 431/286 |
| 5,062,788 | A | * | 11/1991 | Best | 431/7 |
| 5,108,284 | A | * | 4/1992 | Gruswitz | 431/286 |
| 5,628,303 | A | * | 5/1997 | Ahmady et al. | 126/91 A |
| 6,036,481 | A | * | 3/2000 | Legutko et al. | 431/354 |
| 6,347,935 | B1 | * | 2/2002 | Schindler et al. | 431/5 |
| 6,729,874 | B2 | * | 5/2004 | Poe et al. | 431/354 |

* cited by examiner

*Primary Examiner*—Josiah C. Cocks
(74) *Attorney, Agent, or Firm*—Wall Marjama & Bilinski LLP

(57) ABSTRACT

An inshot gas burner having an overall length of less than four inches that is capable of delivering between 5,000 and 5,800 Btus per unit length of burner per hour. The burner venturi section with a flame retainer positioned at its outlet that produces a firing rate of at least 9,900 Btus per inch of diffuser length.

27 Claims, 5 Drawing Sheets

MICRO INSHOT BURNER

CROSS REFERENCE TO RELATED APPLICATION

This is a continuation application of U.S. Ser. No. 10/045,994, filed Oct. 19, 2001, now abandoned, the entirety of which is incorporated herein by reference.

FIELD OF THE INVENTION

This invention relates generally to a burner for a gas fired furnace, and specifically to a gas burner having a foreshortened axial length and a performance about equal to burners of greater length.

BACKGROUND OF THE INVENTION

Most in-shot burners found in the prior art have an overall length of five inches or more. The term overall length as herein used, refers to the axial length of the burner assembly as measured over the spud holder located at the input end of the burner and the flame retainer housing located at the output end of the burner. Attempts to reduce the length of in-shot burners used in gas furnaces and, in particular, non-condensing multi-poise furnaces, have resulted in a reduction in burner performance primarily because the shorter burners generally can not effectively draw in sufficient primary air to optimally support combustion. In addition, shorter burners found in the prior art do not provide good fuel and air mixing or the stable burning characteristics needed to avoid pulsation, blow-off and flashback in the burner. Shorter burners are highly desirous in multi-poised furnaces which are designed to operate not only in an upright position, but also when lying on one side or the other or in an inverted position. By shortening the burner section inside the casing, sufficient room can be gained to permit the flue pipe to be repositioned internally to accommodate any of the multiple furnace positions.

Additionally, it has been found that short burners can be readily formed in multiple burner units using well known plate stamping techniques. The burner units can be fabricated containing different numbers to accommodate various size furnaces. The units are easy to install and are not only space saving, but also cost effective.

SUMMARY OF THE INVENTION

It is therefore an object of the present invention to improve gas furnaces by shortening the length of the burner section without adversely effecting furnace performance.

It is a further object of the present invention to provide, a gas burner for a multi-poise furnace that saves sufficient space within the furnace casing to allow the vent pipe to be turned to a variety of positions internally to accommodate various furnace operating positions.

Yet another object of the present invention is to provide an in-shot gas burner that is under five inches in length and which exhibits good entrainment properties as well as good stability.

A still further object of the present invention is to provide a burner unit containing a plurality of micro burners that is economical to fabricate and easy to install within a gas furnace.

These and other objects of the present invention are attained by a micro inshot gas burner that is under four inches in length and which is ideally well suited for use in a multi-poised furnace. The burner includes a venturi tube having a converging inlet section and a diverging outlet section. A flame retainer housing is joined to the outlet section of the venturi tube and contains a flame retainer. A spud holder is mounted adjacent to the inlet section of the venturi tube in axial alignment therewith. The overall length of the burner as measured over the spud holder and the flame retainer housing is less than four inches. The geometry of the burner is such that the burner provides about 20,000 BTU.

BRIEF DESCRIPTION OF THE DRAWING

For a better understanding of the these and other objects of the present invention, reference should be made to the following detailed description of the invention which is to be read in association with the accompanying drawings, wherein.

DETAILED DESCRIPTION OF THE INVENTION

Figure 1:
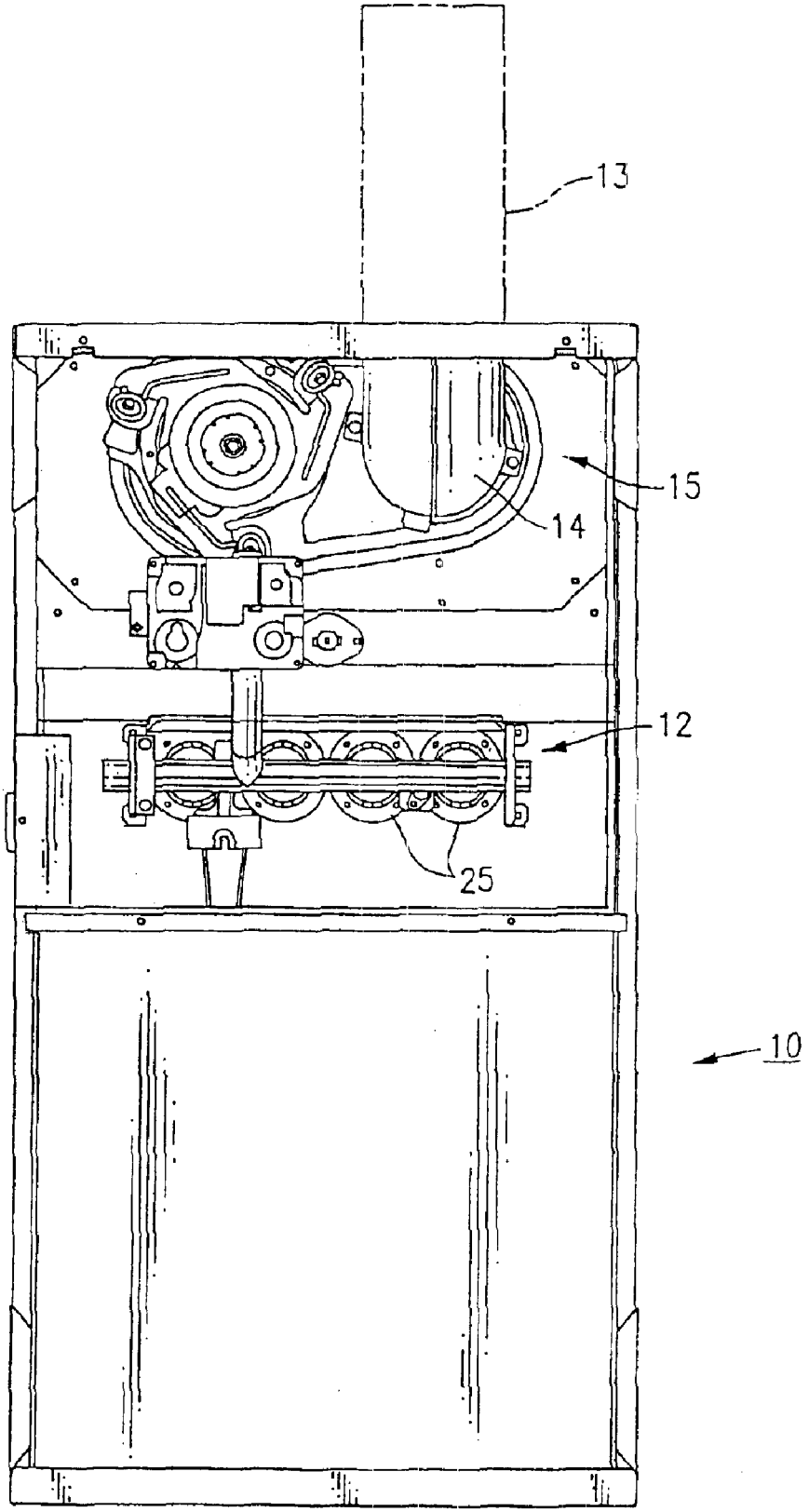
FIG. 1 is a front view of a multi-poised furnace embodying the teachings of the present invention.

Turning initially to FIG. 1, there is shown a multi-poise furnace, generally referenced 10 having the front cover removed to show the location of the burner assembly 12 when the furnace is placed in an upright position. As will be explained in detail below, the burners that are employed in the burner assembly are considerably shorter in length than the conventional burners presently found in the art. Accordingly, sufficient space is provided within the furnace casing in which the furnace flue pipe 13 can be extended internally in the event the furnace is mounted inverted or lying upon either side. The flue pipe system includes an elbow 14 that is rotatably coupled to the outlet of the inducer fan housing 15 that permits the flue pipe to be turned in several directions within the furnace casing to accommodate the particular mounting position of the furnace.

Figure 2:
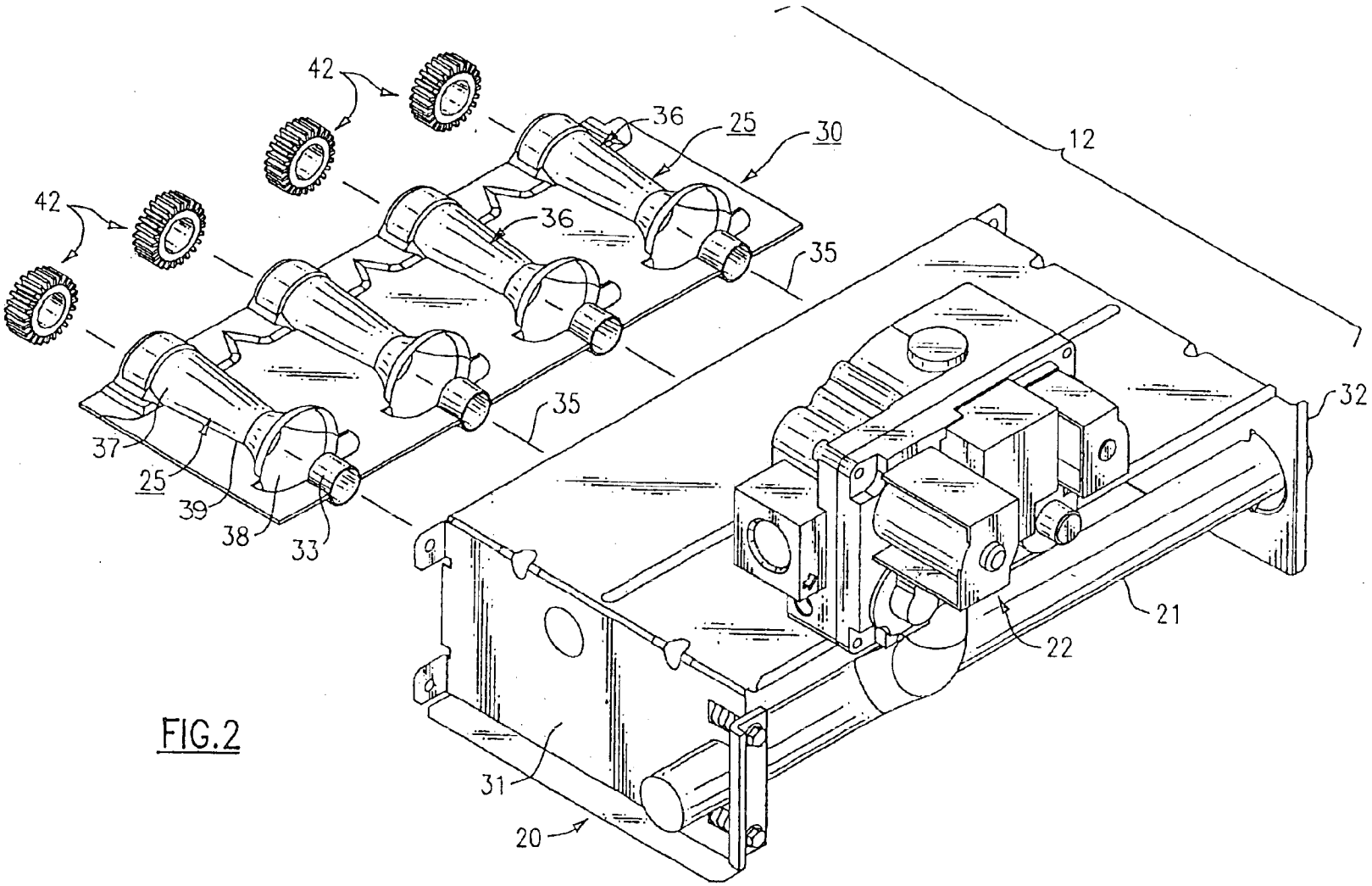
FIG. 2 is an enlarged exploded view in perspective illustrating the burner section of the furnace shown in FIG. 1.
Figure 3:
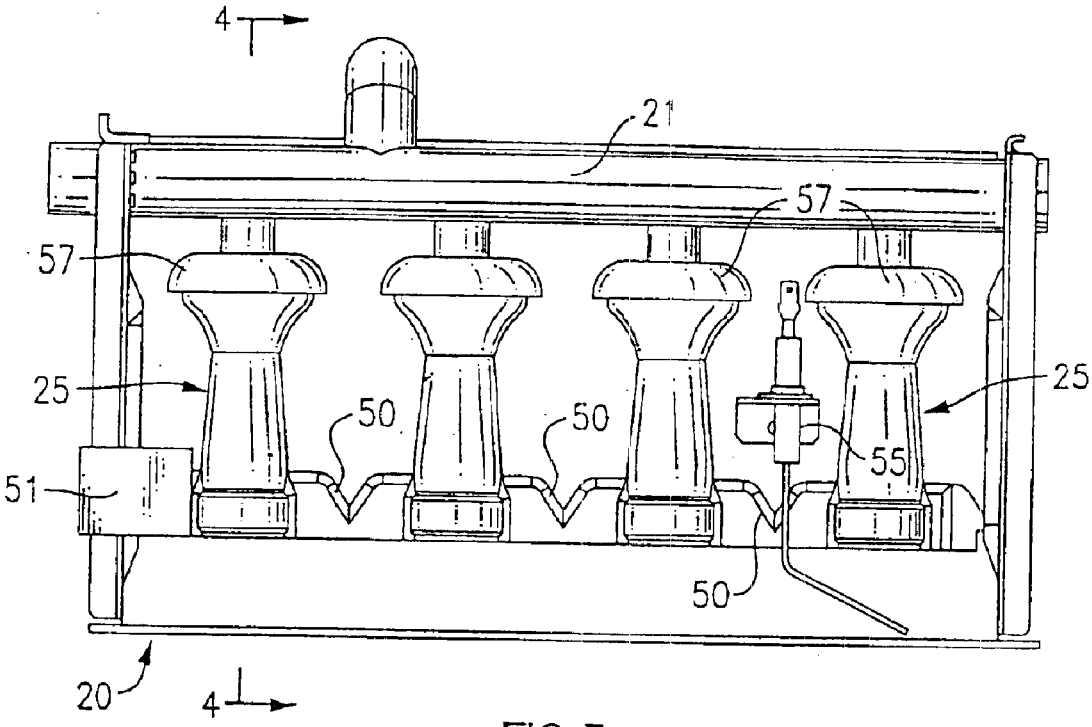
FIG. 3 is a bottom view of the burner section shown in FIG. 2.
Figure 4:
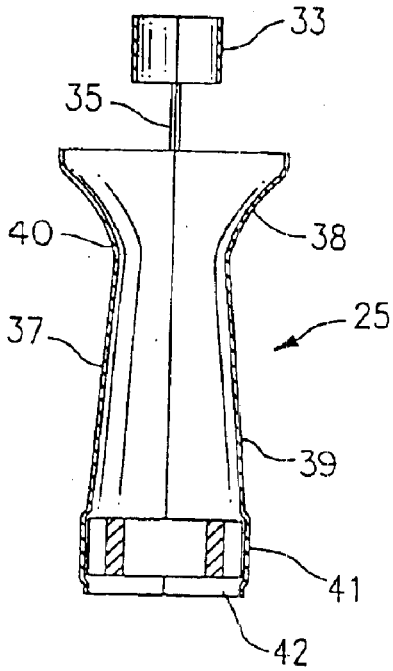
FIG. 4 is an enlarged section taken along lines 4—4 in FIG. 3.

Turning now to FIG. 2, there is shown the burner assembly 12 of the multi-poise furnace. The section includes a support frame 20 containing a gas manifold 21 and a gas valve 22 for metering gas to the manifold at a desired rate. Although not shown, the manifold contains one or more equally spaced nozzles or "spuds" each of which directs gas from the manifold under pressure into one of the burners 25 utilized in the furnace. Although four burners are employed in the present furnace, more or less burners may be utilized, depending upon the heating capacity of the furnace. In this embodiment, the burners are all formed as a separate unit 30 from two stamped flat metal plates. The unit, in turn, is mounted between the side walls 31 and 32 of the frame 20. Each burner is equipped with a spud holder 33 at the inlet to the burner. The spud holder is a cylindrical element that is adapted to pass over one of the associated spuds and helps to align the spud with respect to an associated burner.

With further reference to FIGS. 3–6, the top plate 37 and the bottom plate 38 of the burner unit 30 are stamped so that the top plate contains the upper half geometry of each burner and the bottom plate contains the lower half geometry of each burner. The plates thus divide the burners symmetrically along the central axis 35 of each burner so that when the plates are brought together in assembly in face to face contact, the overall shape of each burner is produced. The plates are cojoined in assembly by any suitable means such as spot welding or the like so that the opposed flat surfaces of the plates are held in close intimate contact along the length and breadth of the plates.

Figure 5:
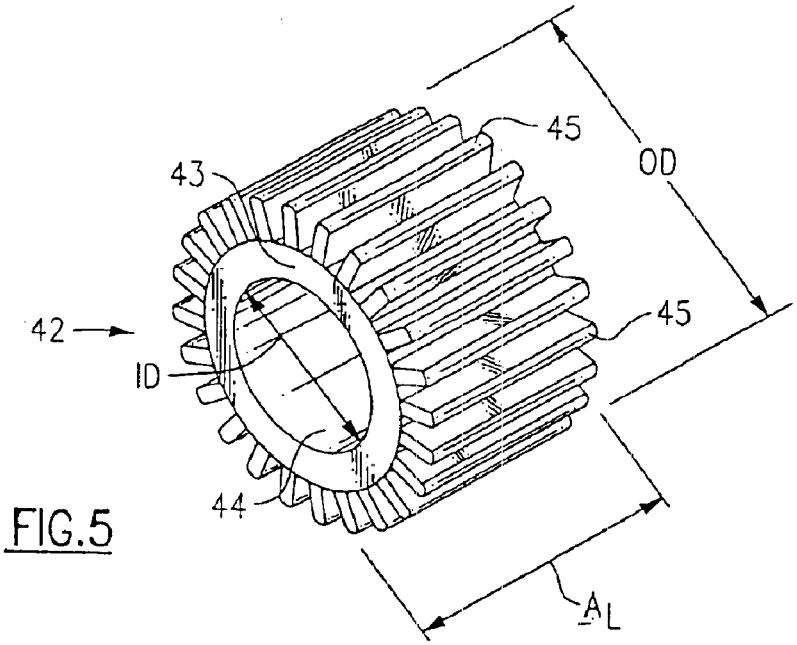
FIG. 5 is an enlarged perspective view of a first flame retainer suitable for use in the present invention.

Each burner includes the previously noted spud holder 33 that is centered upon the axis 35 of the burner and is positioned adjacent to and in axial alignment with a venturi tube 37. Each venturi tube contains a converging inlet section 38 that communicates with a diverging outlet section 39 through a necked down throat 40. A flame retainer housing 41 is integrally joined to the outlet side of the venturi tube and contains a cylindrical type flame retainer. One type of flame retainer is illustrated in FIG. 5. The flame retainer includes a cylindrical hub 43 with a centrally located hole 44 having an inside diameter (ID). A plurality of axially aligned splines 45 radially extend about the outer periphery of the hub. The splines are equally spaced about the hub and are brought to a radial depth that is about 25% that of the outside diameter (OD) of the flame retainer. Preferably, the hub contains 24 splines and the sidewalls of each spline converges radially in an outward direction at an angle of about 15°. The axial length (AL) of the flame retainer is about one-third the outside diameter of the retainer, while the inside diameter of the hub is about one half the outside diameter of the retainer.

Figure 7:
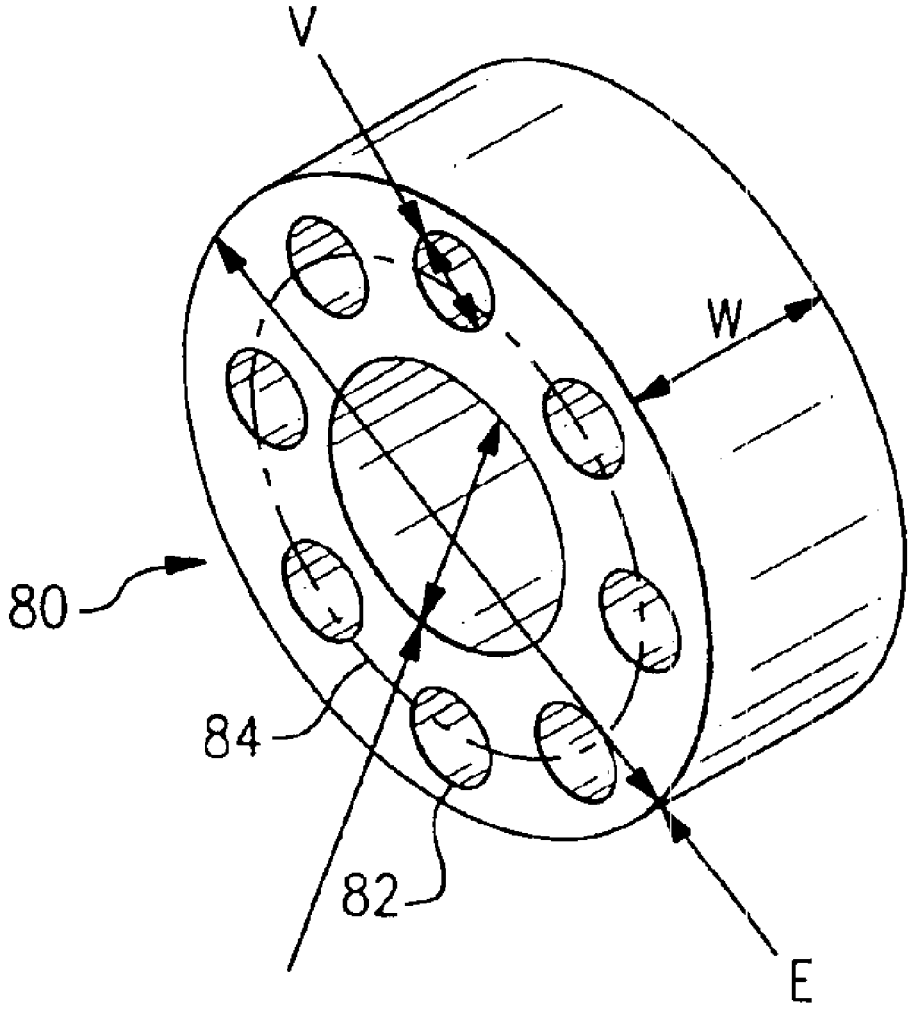
FIG. 7 is an enlarged perspective view of a second flame retainer suitable for use in the practice of the present invention.

A second type of flame retainer, generally referenced 80, is illustrated in FIG. 7. The retainer is basically in the shape of an annular ring having an outside diameter E of about 1.03" and an inside diameter F of about 0.457". The retainer has an axial length W of about 0.368." A series of through holes 82—82 are equally spaced about a hole circle 84 that is centered between the inside diameter and the outside diameter of the retainer. Although the number of smaller through holes may vary depending on the particular application, eight holes each having a diameter V of about 0.157" are employed in this embodiment of the invention. Although the outside diameter of the retainer may vary in various applications, it is desirous to maintain the relationship of the central hole diameter to the outside diameter constant for all applications. That is, the outside diameter of the retainer should be about 2.23 that of the retainer's inside diameter and the outside diameter of the retainer should be about 6.62 times that of each of the smaller through holes.

Figure 6:
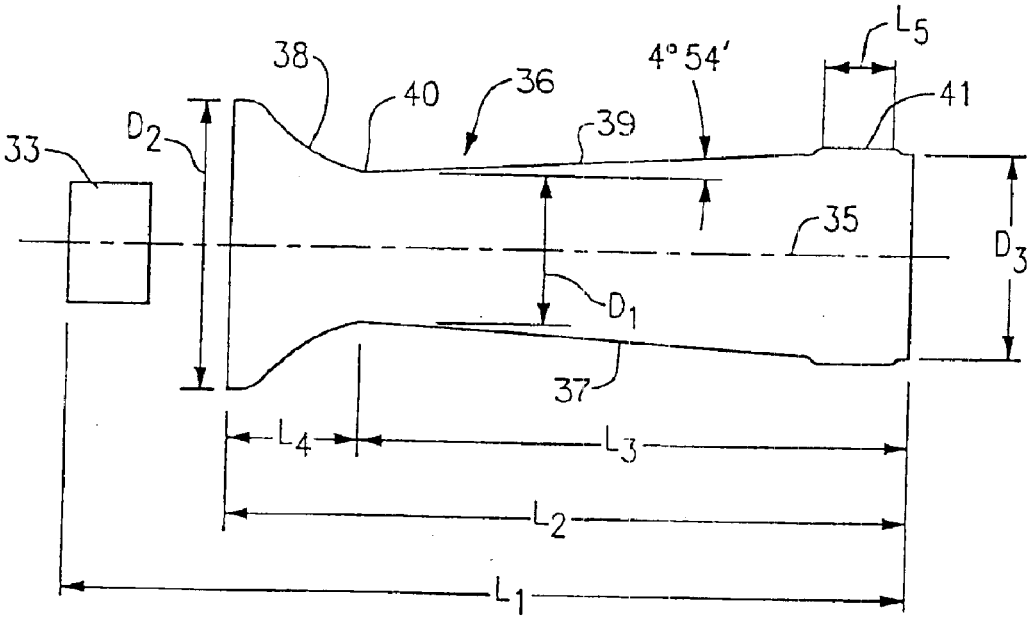
FIG. 6 is an enlarged schematic view of a single burner showing the geometry of the burner in greater detail.

The geometry of each burner is shown in further detail in FIG. 6, wherein:

$D_1$ is the throat diameter of the venturi tube;
$D_2$ is the entrance diameter of the venturi inlet section;
$D_3$ is the exit diameter of the venturi outlet section;
$L_1$ is the axial length of the entire burner measured over the spud holder and the flame retainer housing;
$L_2$ is the axial length of the venturi tube including the flame retainer housing;
$L_3$ is the combined axial length of the diffuser section of the venturi tube and the flame retainer housing;
$L_4$ is the axial length of the inlet section of the venturi tube; and
$L_5$ is the axial length of the flame retainer housing.

Through computations and experimentation, burner parameters have been arrived at that provide a burner having an overall axial length of about 3.8 inches that is capable of delivering between 5,000 and 5,800 Btus per unit of length per hour and an input rate over the diffused length of about 9,900 Btus per inch. This micro burner's capacity is thus equal to or better than more conventional gas burners having an overall length of 5 inches or more. As a result, a considerable space savings is realized within the furnace casing which permits the flue pipe to pass within the furnace casing. Accordingly, the present burner is ideally suited for use in multi-poised furnaces.

Testing showed that changes in the inside diameter of the flame retainer and the exit diameter of the venturi tube had the greatest effect on burner performance. Further testing of a 3.8 inch burner found that the optimum exit diameter of the venturi was about between 0.900 inches and 1.00 inches with 0.98 inches being optimum. This, in turn, dictated the approximated outside diameter (OD) of the flame retainer which is about equal to the exit diameter of the venturi tube. The size of the ID opening was adjusted to determine optimum burning characteristics. With about a 1.00 inch outside diameter and about a 0.46" inside diameter, the retainers as herein described provided the necessary primary air entrainment and mixing within the burner as well as an overall reduction in noise levels. Although the remaining burner parameters were found to have a lesser effect on burner performance, further testing identified optimum size ranges for these parameters.

By maintaining a throat diameter ($D_2$) of about between 0.650–0.70 inches and holding the angle of divergence to between 4° and 5°, a desired capacity of between 5,000 and 5,800 Btus per inch of burner per hour was maintained. The entrance to the venturi tube ($D_2$) is between 1.40 and 1.50 inches with the entrance being located a distance ($L_4$) about 0.690 to 0.710 inches from the venturi throat. The combined length ($L_2$) of the venturi tube and the retainer housing was held to between 2.9 inches and 3.00 inches with the axial length ($L_5$) of the housing being about 0.38 inches. Accordingly, the diverging section of the venturi tube is about 1.44 times that of the throat and the entrance diameter is about 2.11 times that of the throat. Tests conducted upon the shortened burners confirmed experimentally applicants' calculations and enabled applicants to further refine the 3.8 inches burner geometry within the above noted ranges.

Turning once again to FIG. 3, each of the aligned burners in the burner unit is connected to its neighbor by a channel 50 that is stamped into at least one of the plates 37–38 defining the geometry of the burner unit. An igniter 51 is mounted in the frame 20 next to a first burner located at one end of the burner alignment. The igniter is arranged to provide a hot surface to the first burner outlet section at start up to light the air/gas mixture moving through the burner. At the burner outlet, fuel ignited at the trailing edge of the channel spreads laterally to ignite the next burner in the series and so on down the alignment. A flame detector 55 is mounted in the frame adjacent to the last burner in the series which will detect a flame if all the burners in the series have lighted. If it is determined that the burners have not all ignited within a given period of time, the gas valve 22 is deprived of current which, in turn, shuts off the flow of gas to the burners.

A generous opening 57 is stamped into each of the plates 35,36 between the spud holder exit and the entrance to the venturi tube. The width of the opening is at least equal to the diameter of the venturi entrance. The area of each opening is sufficiently large so that an unimpeded flow of air will be available to support the combustion when the burner is operating at capacity.

The plates have an overall width of 3.8 inches which is equal to the overall length of the burners. Accordingly, the entrance to each spud holder is coextensive with one side edge of the plates 37, 38 and the exit to the flame retainer housing is similarly coextensive with the opposite side edge of the plates.

While the present invention has been particularly shown and described with reference to the preferred mode as illustrated in the drawing, it will be understood by one skilled in the art that various changes in detail may be effected therein without departing from the spirit and scope of the invention as defined by the claims.

We claim:

1. An inshot, induced draft gas burner for use in a furnace that includes a venturi tube having a converging inlet section and a diverging outlet section that communicates through a restricted throat wherein an angle of divergence of the outlet section is greater than 4° and further includes a generally cylindrical flame retainer housing at the exit of said outlet section which houses a flame retainer, a spud holder is axially aligned with said venturi tube adjacent to the entrance to the inlet section wherein the axial distance as measured over the spud holder and the flame retainer housing of the venturi tube is less than 5.00 inches and the burner capacity is between 5,000 and 5,800 Btus per inch of burner per hour, wherein the throat has a diameter in the range of 0.650 inches and 0.70 inches.

2. The gas burner of claim 1 having a firing rate of at least 9,900 Btus per inch of diffuser length.

3. The gas burner of claim 1 wherein the throat has a diameter of about 0.682 inches.

4. The gas burner of claim 1 wherein the exit diameter of the diverging section of the venturi tube is about 1.44 times that of said throat.

5. The gas burner of claim 1 wherein the entrance diameter of the converging section of the venturi tube is about 2.11 times that of the throat.

6. The gas burner of claim 1 wherein the throat of the venturi tube is located an axial distance from the entrance to the venturi tube that is about 25% of the total combined axial length of the venturi tube and the flame retainer housing.

7. The gas burner of claim 1 wherein the angle of divergence of the outlet section of the venturi tube is between 4° and 5°.

8. The gas burner of claim 1 wherein the axial length of the flame retainer housing is at least 12% that of the combined length of the venturi tube and the housing.

9. The gas burner of claim 1 wherein said flame retainer has an annular hub and a plurality of axially aligned splines that are equally spaced about the hub and has an inside diameter that is about 80% that of the throat diameter of the venturi tube.

10. The gas burner of claim 9 wherein the outside diameter of the flame retainer is about equal to the exit diameter of the diverging section of the venturi tube.

11. The gas burner of claim 10 wherein the axial length of the flame retainer is about one-third that of the outside diameter of the flame retainer.

12. The gas burner of claim 1 wherein the flame retainer is an annular member having an inside diameter and an outside diameter and a series of through holes equally spaced about a hole circle centrally located between the outside diameter and the inside diameter.

13. The gas burner of claim 12 wherein the outside diameter of the flame retainer is about 2.23 times that of the inside diameter.

14. The gas burner of claim 13 wherein the outside diameter of the flame retainer is about 6.62 times that of each through hole.

15. The gas burner of claim 14 wherein the inside diameter of the flame retainer is about one third of its outside diameter.

16. The gas burner of claim 1 wherein the overall length of the burner is less than 4.0 inches.

17. An inshot, induced draft gas burner unit for use in a furnace or the like that includes, a top plate having a plurality of axially aligned, spaced apart stampings, each of which describe the top half of a burner, a bottom plate having a plurality of axially aligned, spaced apart stampings, each of which describes the bottom half of a burner, means for joining together the two plates in face-to-face contact to establish a plurality of burners, each of which includes a spud holder having an entrance that is coextensive with one side edge of the cojoined plates, a venturi tube adjacent to the spud holder that includes a converging inlet section and a diverging outlet section that communicates through a restricted throat and an integral flame retainer housing at the exit of the diverging section that contains a cylindrical flame retainer, the exit of said flame retainer housing being coextensive with an opposing side edge of said plates, the angle of divergence of the outlet section being greater than 4°, said plates further including openings extending between the exit of each spud holder and the entrance to an adjacent venturi tube, and the axial length of each burner as measured over the spud holder and the flame retaining housing being less than 4 inches and each burner having a capacity of between 5,000 and 5,800 Btus per inches of length of burner per hour, wherein said throat has a diameter in the range of 0.650 inches and 0.70 inches.

18. The assembly of claim 17 further including crossover channels formed in one of said plates that extend between the diverging sections of adjacent venturi tubes.

19. The assembly of claim 18 that further includes an igniter means for igniting gas at the outlet of one of said burners whereby the remaining burners are ignited through the connecting crossover channel.

20. The burner assembly of claim 19 wherein said igniter means is associated with a first burner located at one end of the burner alignment and further includes a flame sensor operatively associated with a second burner located at the opposite end of the burner alignment.

21. The burner assembly of claim 17 wherein the exit diameter of the diverging section of the venturi tube is about 0.98 inches.

22. The burner assembly of claim 17 wherein the angle of divergence of the outlet section of the venturi tube of each burner is between 4° and 5°.

23. The burner assembly of claim 17 wherein the entrance diameter of the venturi tube of each burner is between 1.4 inches and 1.5 inches.

24. The burner assembly of claim 17 wherein the combined length of the venturi tube and flame retainer housing of each burner is between 2.9 inches and 3.0 inches.

25. The burner assembly of claim 17 wherein the throat of the venturi tube of each burner is located between 0.690 inches and 0.710 inches from the entrance of the tube.

26. The burner unit of claim 17 wherein the outside diameter of the flame retainer is about equal to the exit diameter of the venturi tube.

27. The burner unit of claim 26 where the axial length of the flame retainer is about 0.38 inches.

* * * * *